US007063121B2

(12) United States Patent
Zorbas et al.

(10) Patent No.: US 7,063,121 B2
(45) Date of Patent: Jun. 20, 2006

(54) SOFT FURNISHING ASSEMBLY AND METHOD OF CONSTRUCTION THEREOF

(76) Inventors: John Zorbas, 10 McPherson Ave, Noranda 6062 (AU); Stavros Zorbas, 86 Robinson Ave., Northbridge 6003 (AU); Tasos Zorbas, B115 Ewen St, Doubleview, W.A 6018 (AU)

( * ) Notice: Subject to any disclaimer, the term of this patent is extended or adjusted under 35 U.S.C. 154(b) by 0 days.

(21) Appl. No.: 10/772,941

(22) Filed: Feb. 5, 2004

(65) Prior Publication Data

US 2004/0216850 A1 Nov. 4, 2004

(30) Foreign Application Priority Data

May 1, 2003 (AU) ..... 2003902071

(51) Int. Cl.
*E06B 9/00* (2006.01)

(52) U.S. Cl. ..... 160/38

(58) Field of Classification Search ..... 160/38, 160/39, 19; 206/746, 748, 736; 248/909
See application file for complete search history.

(56) References Cited

U.S. PATENT DOCUMENTS

| | | | | |
|---|---|---|---|---|
| 2,862,549 | A * | 12/1958 | Robbins | 160/38 |
| 2,894,571 | A * | 7/1959 | Toti | 160/38 |
| 2,998,062 | A * | 8/1961 | Bixby | 160/39 |
| 4,955,419 | A | 9/1990 | Morris | 160/38 |
| 5,042,549 | A * | 8/1991 | Roberts | 160/39 |
| 5,152,331 | A * | 10/1992 | Barone | 160/38 |
| 5,699,902 | A * | 12/1997 | Sperry et al. | 206/219 |
| 5,890,527 | A * | 4/1999 | Smiley et al. | 160/39 |
| 6,152,204 | A * | 11/2000 | Santoro | 160/38 |
| 6,173,752 | B1 * | 1/2001 | Nelson et al. | 160/38 |
| 6,390,436 | B1 * | 5/2002 | Barnes et al. | 248/548 |
| 2002/0179790 | A1 * | 12/2002 | Emrick et al. | 248/262 |

FOREIGN PATENT DOCUMENTS

| | | |
|---|---|---|
| AU | 662591 | 2/1993 |
| AU | 655751 | 7/1994 |
| AU | 710043 | 12/1998 |

* cited by examiner

*Primary Examiner*—Blair M. Johnson
(74) *Attorney, Agent, or Firm*—Fredrikson & Byron, P.A.

(57) ABSTRACT

A soft furnishing assembly and method for its construction. The assembly comprises an intermediate portion having opposed ends and at least one end portion connected to an end of the intermediate portion. The end portion is connected by a frangible portion wherein the end portion is movable between a first position in which the soft furnishing assembly is substantially flat and a second position in which the end portion angularly abuts an adjacent end of the intermediate portion and the frangible portion is broken.

22 Claims, 10 Drawing Sheets

SOFT FURNISHING ASSEMBLY AND METHOD OF CONSTRUCTION THEREOF

The present invention relates to a soft furnishing assembly and a method of construction thereof, in particular a pelmet assembly for the dressing of windows and the like.

Pelmets are a well known soft furnishing feature, commonly used to conceal ornamentally features of window dressings or door assemblies such as blind and curtain tracks and sliding door tracks, which may be considered to be unsightly and aesthetically displeasing.

Generally, it may be convenient for the pelmet assembly as manufactured in one piece to also be transported in one piece to a place of installation. This may serve to create difficulties in transport and handling, particularly when the manufactured pelmet is of a large size. Further, current pelmet manufacturing methods typically dictate that the pelmet be manufactured and assembled away from the place of installation. Such manufacturing methods generally create delays in installation of the pelmet and can result in the overall cost of manufacturing being raised above the price range of some consumers. Similar considerations apply to other items of soft furnishing.

The present invention attempts to overcome at least in part the aforementioned disadvantages of previously known soft furnishings.

In accordance with one aspect of the present invention there is provided a soft furnishing assembly, comprising an intermediate portion having opposed ends, and at least one end portion connected to an end of the intermediate portion, the or each end portion being connected to the intermediate portion by a frangible portion, wherein the or each end portion is moveable between a first position in which the soft furnishing assembly is substantially flat and a second position in which the or each end portion angularly abuts an adjacent end of the intermediate portion and the frangible portion is broken.

In accordance with a second aspect of the present invention, there is provided a method of construction of a soft furnishing assembly, comprising an intermediate portion having opposed ends, and at least one end portion connected to an end of the intermediate portion, the or each end portion being connected to the intermediate portion by a frangible portion, the method comprising the steps of:

- engageably arranging a support member upon a rear surface of the intermediate portion;
- moving the or each end portion about an end of the intermediate portion such that the or each end portion moves from a first position in which the soft furnishing assembly is substantially flat to a second position in which the or each end portion angularly abuts the adjacent end of the intermediate portion which causes the or each frangible portion to break; and
- fastening the or each end portion to a side of the support member.

The present invention will now be described, by way of example, with reference to the accompanying drawings, in which FIG. 1 is a perspective view of a soft furnishing assembly, in particular, a pelmet assembly in accordance with one aspect of the present invention;

Figure 1:
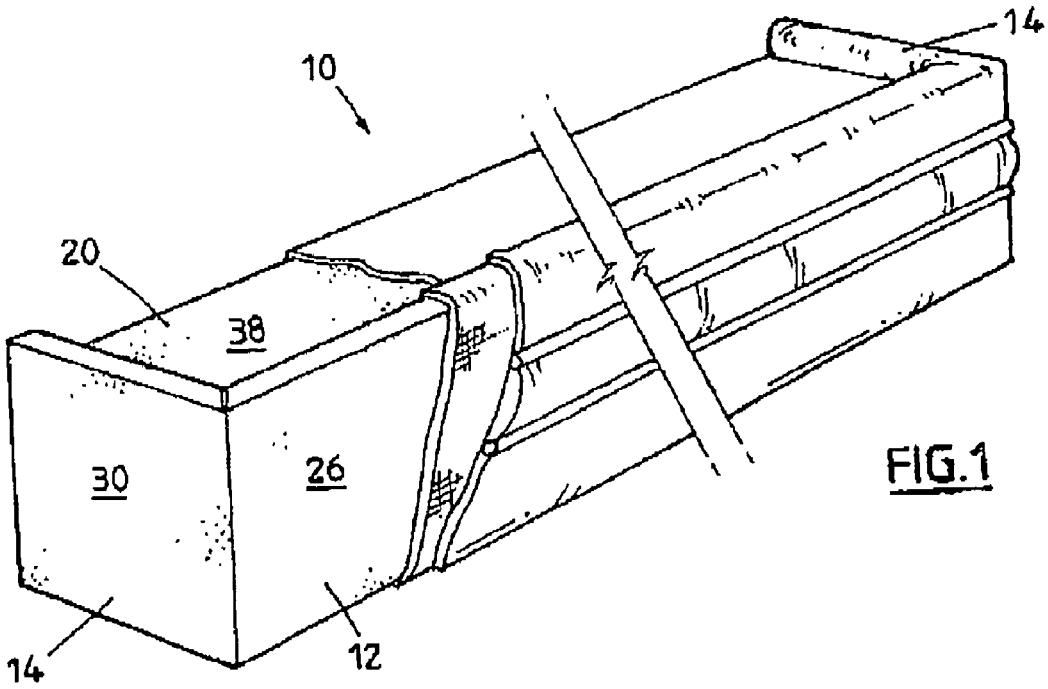
Figure 2:
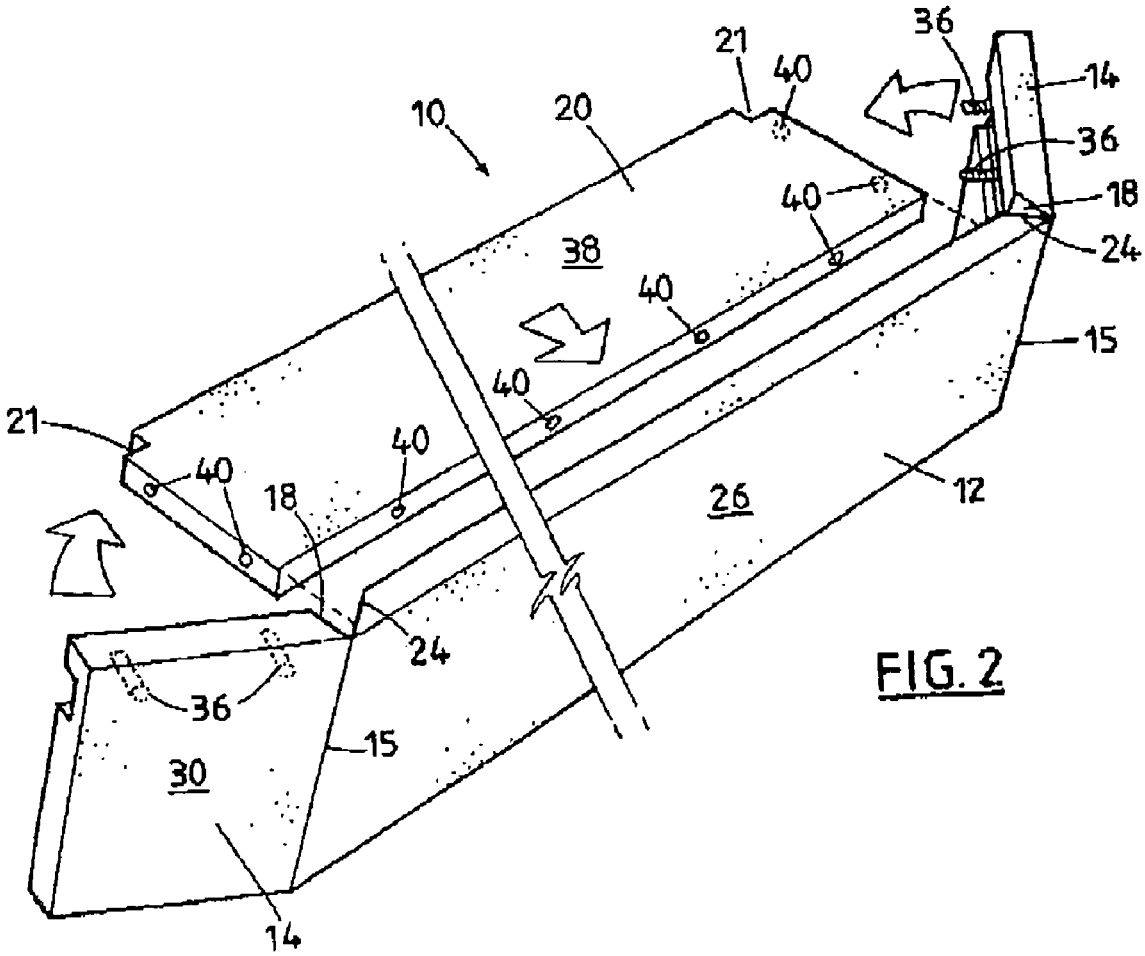
FIG. 2 is an exploded perspective view of the soft furnishing assembly of FIG. 1.

Referring to FIGS. 1 to 8 of the accompanying drawings, there is shown a soft furnishing assembly 10 comprising an intermediate portion 12 and at least one end portion 14. In a preferred embodiment of the present invention, the soft furnishing assembly 10 is provided with a pair of end portions 14 as shown in FIGS. 1 and 2. However, it should be understood that the soft furnishing assembly 10 may be provided with a single end portion 14 only, as dictated by the arrangement of the place of installation of the soft furnishing assembly 10. For example, one end of the soft furnishing assembly 10 could abut a wall disposed at right angles to a window opening.

The intermediate portion 12 is a substantially flat, elongate member with a front surface 26, an opposed rear surface 28 and opposed end surfaces 24. The front and rear surfaces 26, 28 serves as a face onto which decorative material, such as fabric, may be applied. For example, the intermediate portion 12 may be upholstered with a fabric. Alternatively, the front surface 26 may have other suitable material, such as bamboo attached thereto.

Typically, the front and rear surfaces 26 and 28 of the intermediate portion 12 are substantially rectangular in shape, although it is envisaged that any suitable shape may also be employed as desired. The end surfaces 24 of the intermediate portion 12 are inclined at an acute angle to the front and rear surfaces 26 and 28. In a preferred embodiment, the inclined end surfaces 24 of the intermediate portion 12 are such that a longitudinal cross-section of the intermediate portion 12 is substantially trapezoidal in configuration. The intermediate portion 12 is typically formed of any suitable, non-deformable material that is able to maintain the shape of the soft furnishing assembly 10, such as chipboard, wood or a relatively hard plastic material.

Each end portion 14 also includes a front surface 30 and an opposed rear surface 32. The front surface 30 serves as a face onto which suitable padding and decorative material may be affixed or upholstered onto. Each end portion 14 is further provided with an inclined surface 18 at an end thereof, proximal to a respective end surface 24 of the intermediate portion 12. The inclined surface 18 of each end portion 14 is the same length as the adjacent end surface 24 of the intermediate portion 12.

Figure 5:
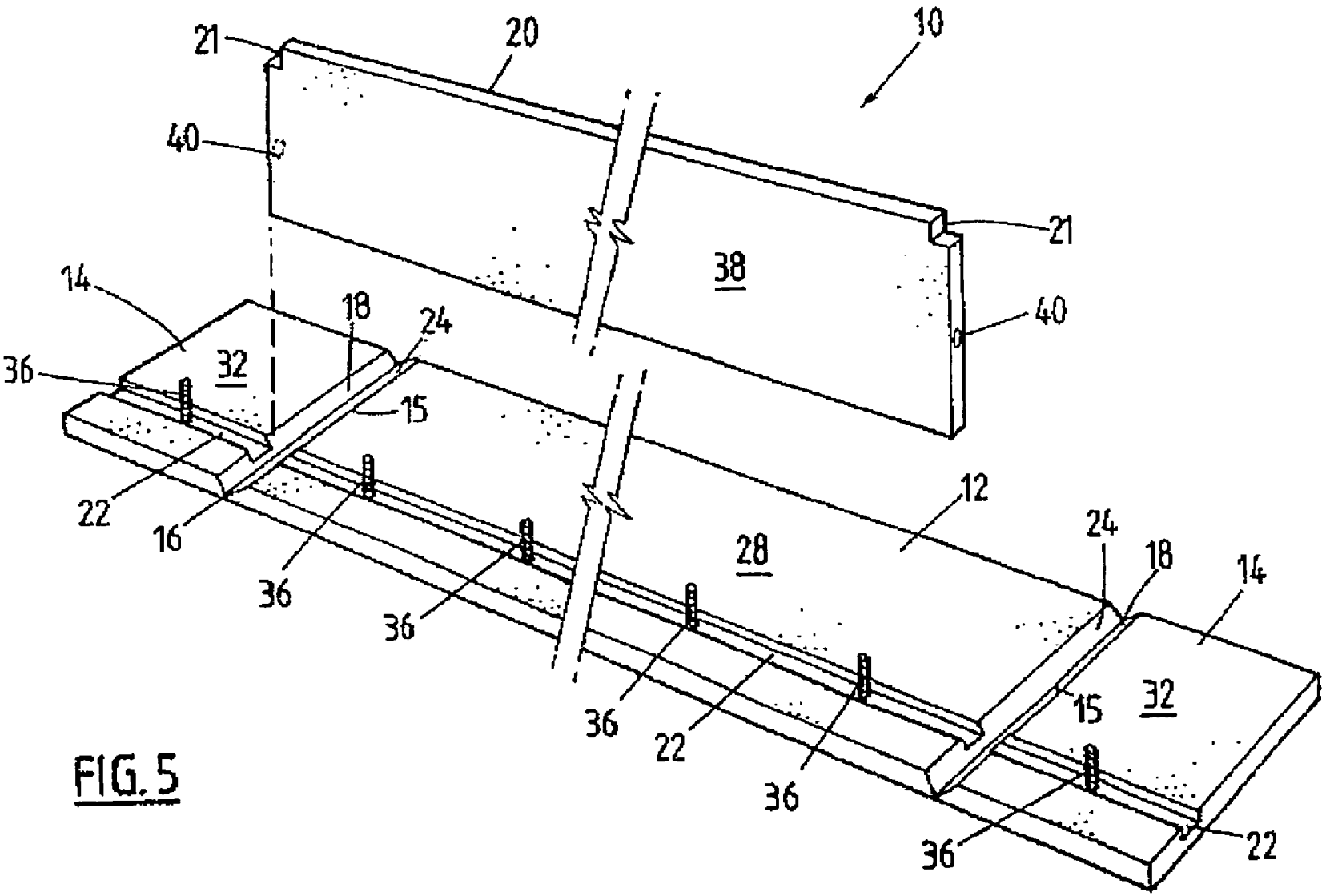
FIG. 5 is a perspective view of the soft furnishing assembly of FIGS. 1 and 2, showing the soft furnishing assembly in a first position prior to construction.
Figure 6:
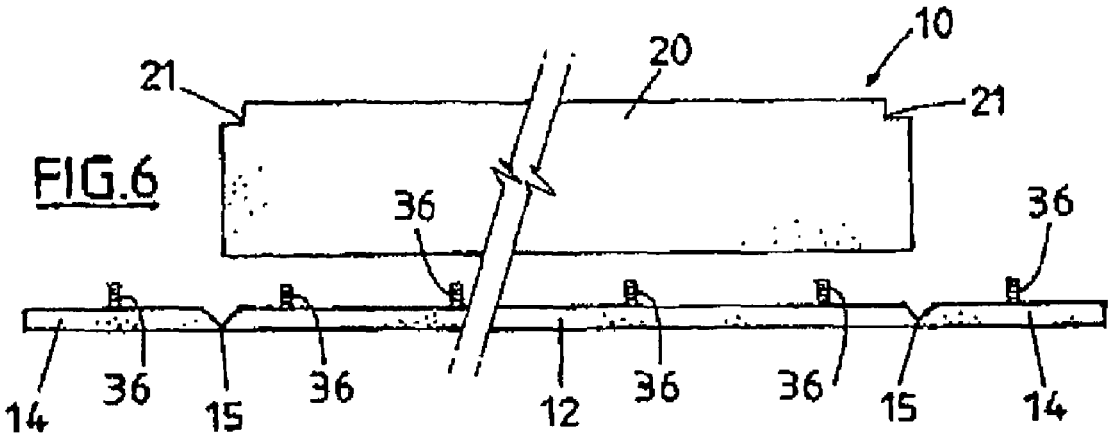
FIGS. 6 to 8 are each an upper perspective view of the soft furnishing assembly of FIGS. 1 and 2 showing the stages of construction of the soft furnishing assembly.

Referring to FIGS. 5 and 6, when the soft furnishing assembly 10 is disposed in the first position, the front surface 30 of the intermediate portion 12 and the front surface 30 of the end portions 14 are longitudinally aligned such that the inclined surface 18 of the end portion 14 and the end surface 24 of the intermediate portion 12 define a substantially V-shaped groove 16. A frangible portion 15 is disposed at a trough of the V-shaped groove 16.

The frangible portion 15 extends along the latitudinal length of the inclined surface 18 of the end portion 14 and of the end surface of the intermediate portion 12. The frangible portion 15 between each end portion 14 and the respective end surfaces 24 of the intermediate portion 12 is thinner than the end portions 14 and the intermediate portion 12.

The frangible portion 15 is arranged to be broken when the end portions 14 are moved from a first position in which the soft furnishing assembly 10 is substantially flat, to a second position in which the end portions 14 angularly abut adjacent ends 24 of the intermediate portion 12, as shown in FIG. 1. Breakage of the frangible portion 15 is enabled by the relative thinness relative to the end portions 14 and intermediate portion 12.

The frangible portion 15 is of a thickness and strength that enables the end portions 14 and intermediate portion 12 to be transported as a single piece whilst enabling breakage thereof when the end portions 14 are moved to the second position during in construction of the soft furnishing assembly 10. Loss or misplacement of the intermediate portion 12 or end portions 14 in transit is a possibility if these components were to be provided as separate, unassembled components. The provision of the intermediate and end portions 12, 14 of the soft furnishing assembly 10 joined as a single unit by the frangible portion 15 assists transportation of the soft furnishing assembly 10 by preventing such loss or misplacement of these components in transit. Further, the provision of the intermediate and end portions 12, 14 as a single unit assists in self assembly and/or self installation of the soft furnishing assembly 10 by a consumer as any uncertainty about the positioning of these portions during self assembly and/or self installation of the soft furnishing assembly 10 is thereby removed.

The intermediate portion 12 and end portions 14 are each further provided with a channel 22 as shown in FIG. 5. The channel 22 is disposed linearly substantially along the length of the rear surface 28 of the intermediate portion 12 and of the rear surface 32 of each of the end portions 14. The channel 22 of the intermediate portion 112 is aligned with the channel 22 of each of the end portions 14, wherein the channel 22 of the intermediate portion 12 and the end portions 14 are longitudinally aligned when the soft furnishing assembly 10 is in the first position as shown in FIG. 5.

The channel 22 is arranged to receive a support member 20. The support member 20 is a substantially flat panel, with an upper surface 38 and a lower surface 39. The support member 20 is arranged to be inserted into the channel 22 of the intermediate portion 12 and of the end portions 14 to maintain and support the soft furnishing assembly 10 when in the assembled configuration.

The support member 20 is further provided with at least one notch 21, disposed on an edge of the support member 20 that is adjacent the end portion 14 and distal to the intermediate portion 12. Upon movement of the end portions 14 into the second position, fabric may bunch within the groove 16 and protrude outwardly therefrom. The bunching of the fabric may obstruct placement of the support member 20 into the channel 22, as well as being aesthetically displeasing in the assembled soft furnishing 10. The notch 21 provides a space into which the bunched fabric may be placed, thereby preventing obstruction of the placement of the support member 20 into the channel 22.

A plurality of securing means are provided to attach the support member 20 to the intermediate portion 12 and also to the end portions 14. The securing means are provided as a plurality of fastening members 36. The fastening members 36 are arranged at intervals along the length of the channel 22 as shown in FIG. 5. The support member 20 is accordingly provided with apertures 40 on the sides that are placed into the channel 22, corresponding to the placement of the fastening members 36 along the channel 22. The fastening members 36 are further provided as a type that fastens automatically upon insertion into the apertures 40, such as a christmas tree screw.

As the soft furnishing assembly 10 is arranged to be stored and transported in a flat-pack prior to assembly, the fastening members 36 that protrude from the channel 22 may be concealed by the provision of recesses (not shown) on the upper surface 38 of the support member 20. In this manner, the support member 20 may be placed over one of the end portions 14 and a portion of the intermediate portion 12, such that the recesses present on the support member 20 fit over the fastening members 36. Preferably, the recesses are arranged on the upper surface 38, so that the recesses are not clearly visible when the soft furnishing assembly 10 has been suitably installed.

Figure 3:
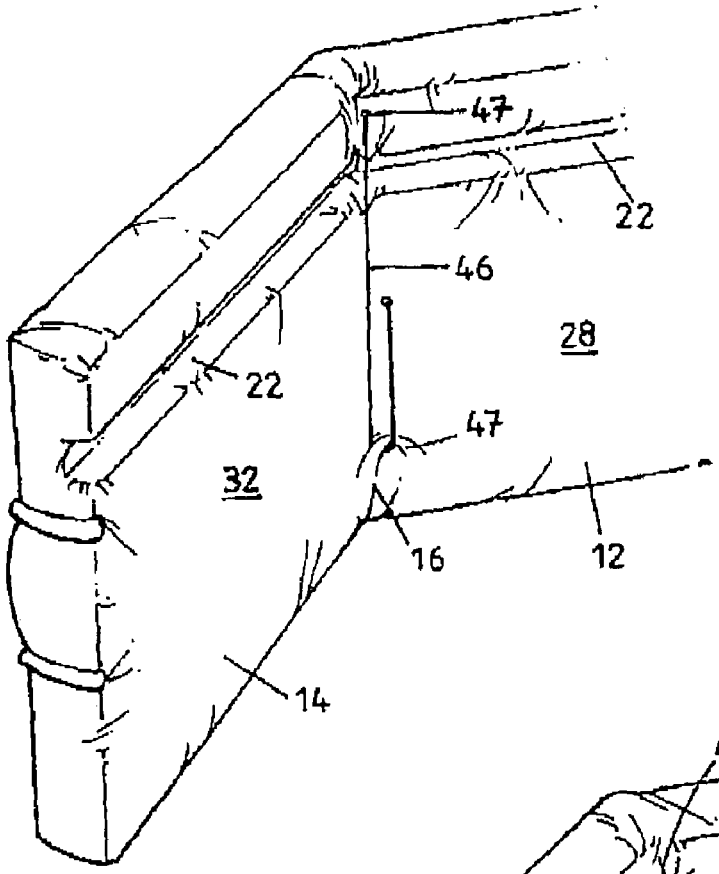
FIG. 3 is a perspective view of an end portion of the soft furnishing assembly of FIGS. 1 and 2, showing a first fabric tensioning means.

The soft furnishing assembly 10 is further provided with a fabric tensioning means such as in the form of a flexible cord 46, as shown in FIG. 3. The flexible cord 46 is arranged along the length of the groove 16 of the rear of the soft furnishing assembly 10.

The flexible cord 46 is attached at a first end to a portion of fabric 47 that protrudes from the groove 16 when the soft furnishing assembly 10 is placed in the second position. An intermediate portion of the flexible cord 46 is attached to an opposing portion of fabric 47 protruding from the groove 16. The flexible cord 46 is then tensioned by pulling the flexible cord 46 through the opposing portion of fabric 47 and towards the first end of the flexible cord 46. A second end of the flexible cord 46 is then secured to any suitable region of the rear of the soft furnishing assembly 10. In this manner, the fabric tensioning means may prevent fabric from protruding from the groove 16 when the soft furnishing assembly 10 is in the second position.

Figure 4:
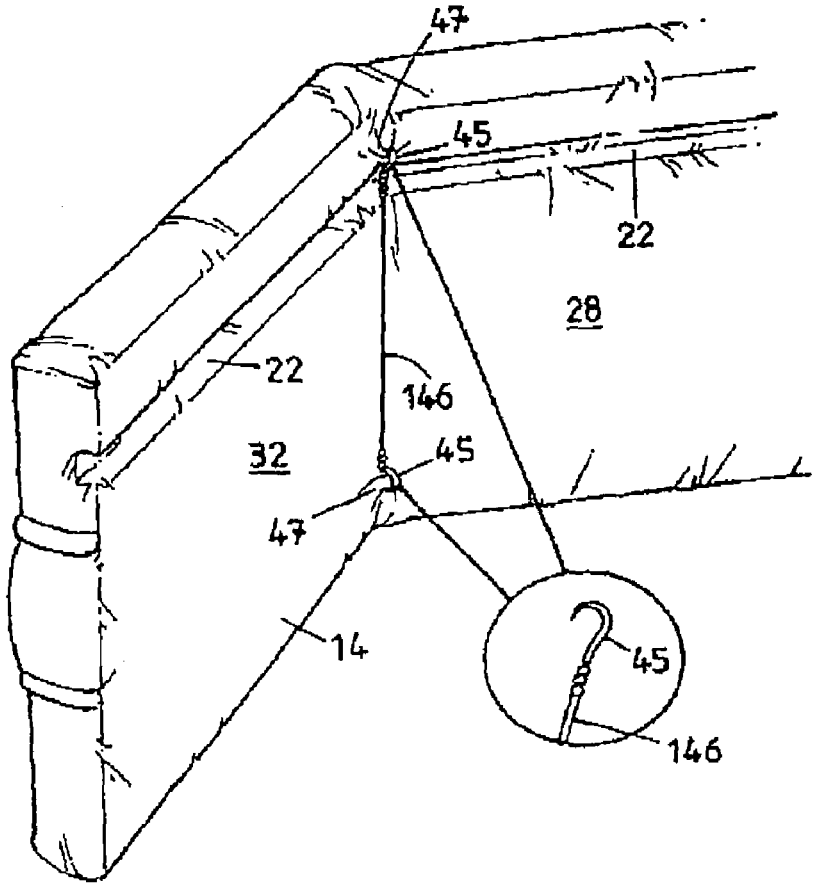
FIG. 4 is a perspective view of the end portion of FIG. 3, showing a second embodiment of the fabric tensioning means.

An alternative fabric tensioning means is also provided as shown in FIG. 4. The tensioning means comprises a flexible cord 146, arranged along the length of the groove 16 of the rear of the soft furnishing assembly 10. The flexible cord 146 is attached at respective ends to a pair of opposing hook members 45. The hook members 45 are arranged to project from the opposing portions of fabric that protrude from the groove 16 when the soft furnishing assembly 10 is in the second position. The tensioning means acts to prevent fabric from protruding from the groove 16 when the soft furnishing assembly 10 is in the second position.

Upon packaging of the soft furnishing assembly 10 for sale or transport in a flat-pack arrangement, the support member 20 may be placed over one of the end portions 14 and a portion of the intermediate portion 12. A packing panel (not shown) is also provided, the packing panel being a flat elongate member, arranged to be placed over the remaining length of the soft furnishing assembly 10. The packing panel may optionally have an indentation present on a surface of the packing panel. The indentation may be used to store hardware, such as screws and fastening members 36, necessary for the assembly or installation of the soft furnishing assembly 10.

The packing panel may further be provided with recesses corresponding to the arrangement of fastening members 36 of the portions of the soft furnishing assembly 10 not concealed by the recesses present on the upper surface 38 of the support member 20. The recesses present on the support member 20 and the packing panel are of dimensions that are greater than those of the fastening members 36, to prevent the fastening members 36 from becoming lodged in the recesses.

Figure 7:
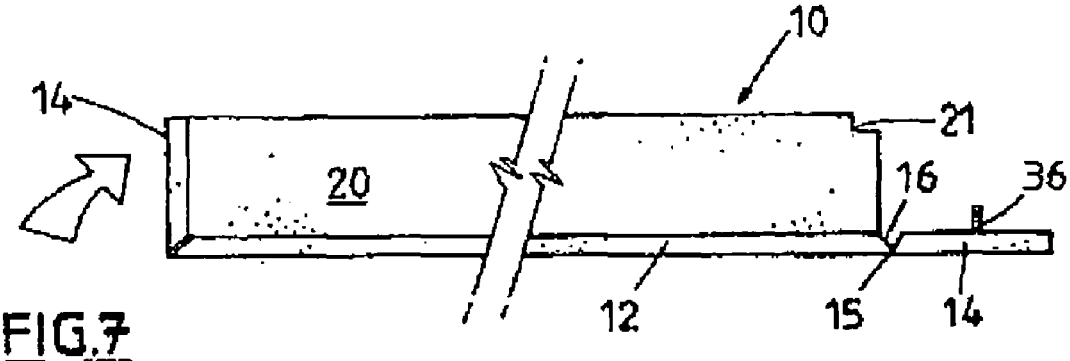

In use, the intermediate portion 12 with end portions 14 attached at ends 24 thereof by the frangible portions 15 is placed so that the channel 22 faces upwards, as shown in FIGS. 5 and 6. The support member 20 is placed within the channel 22 of the intermediate portion 12 such that the corresponding apertures 40 in the side of the support member 20 receive the fastening members 36 extending from the channel 22. The frangible portion 15 is broken by movement of the end portions 14 into the second position, wherein the end portions 14 are angled towards the rear surface 28 of the intermediate portion 12. The end portion 14 thus angularly abuts the end 24 of the intermediate portion 12, as shown in FIG. 7.

The corresponding apertures 40 present on the sides of the support member 20 receive the fastening members 36 present on the channel 22 of the end portion 14, whereupon the fastening members 36 secure the support member 20 to the end portion 14.

Figure 8:
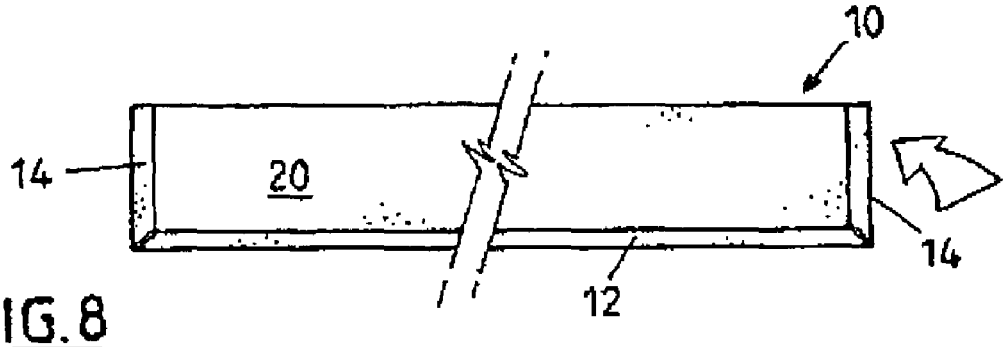

This step, shown in FIG. 8, is then repeated with the opposing end portion 14 to achieve the assembled soft famishing 10, ready for installation, as shown in FIG. 1.

Figure 9:
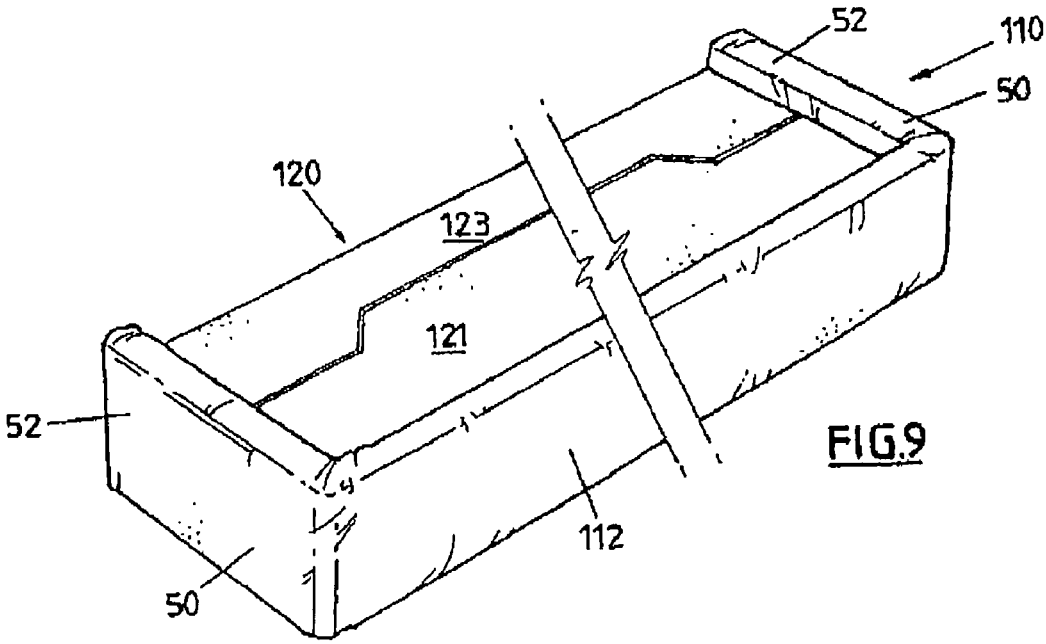
FIG. 9 is a perspective view of a soft furnishing assembly, in particular a pelmet assembly, in accordance with a second aspect of the present invention.
Figure 10:
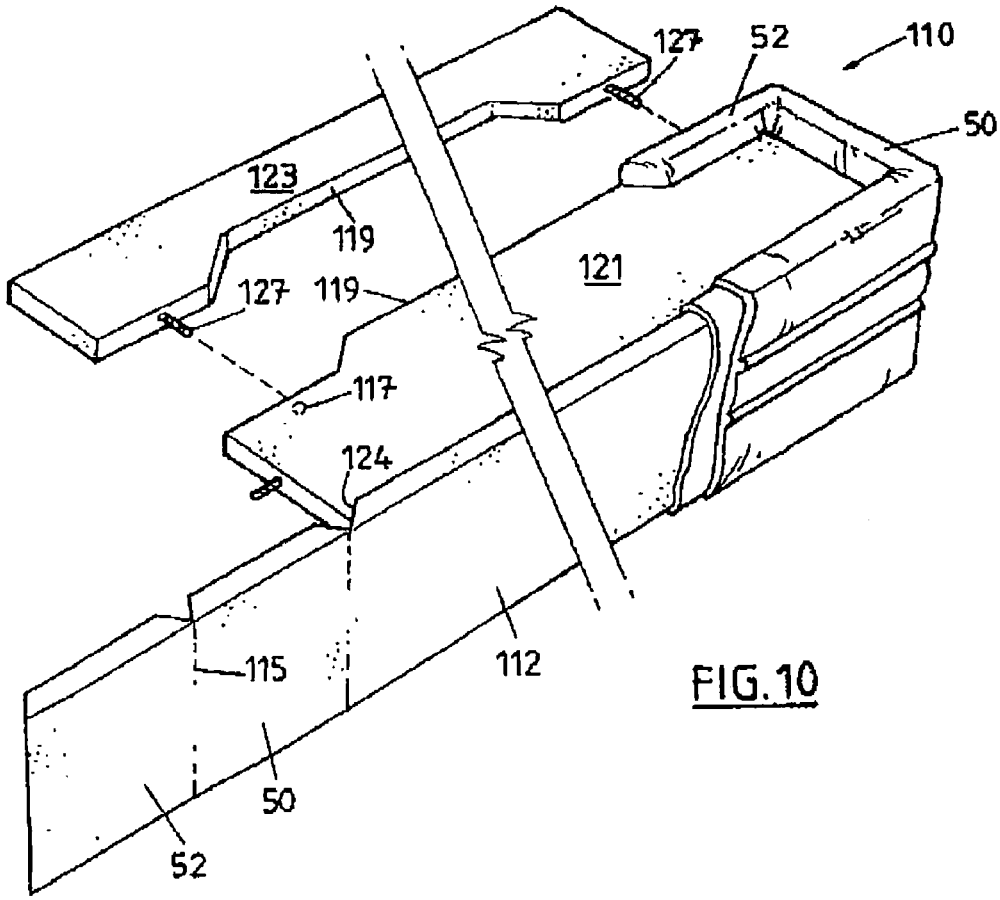
FIG. 10 is an exploded perspective view of the soft furnishing assembly of FIG. 9.

A second embodiment of the present invention, shown in FIGS. 9 to 14 of the accompanying drawings will now be described. Referring to FIGS. 9 and 10, there is shown a soft furnishing assembly 110 comprising an intermediate portion 112 with at least one end portion 114. The intermediate portion 112 is substantially as hereinbefore described with respect to the previous embodiment.

In a preferred embodiment, each end portion 114 comprises a first end portion 50 and second end portion 52. However, it should be understood that each end portion 114 may be comprised of a plurality of end portions, each connected by a frangible portion 115.

Each end portion 114 is connected to ends 124 of the intermediate portion 112 by frangible portions 115. The first and second end portions 50, 52 are also connected by a frangible portion 115. The frangible portions 115 are substantially as hereinbefore described with respect to the previous embodiment.

Figure 11:
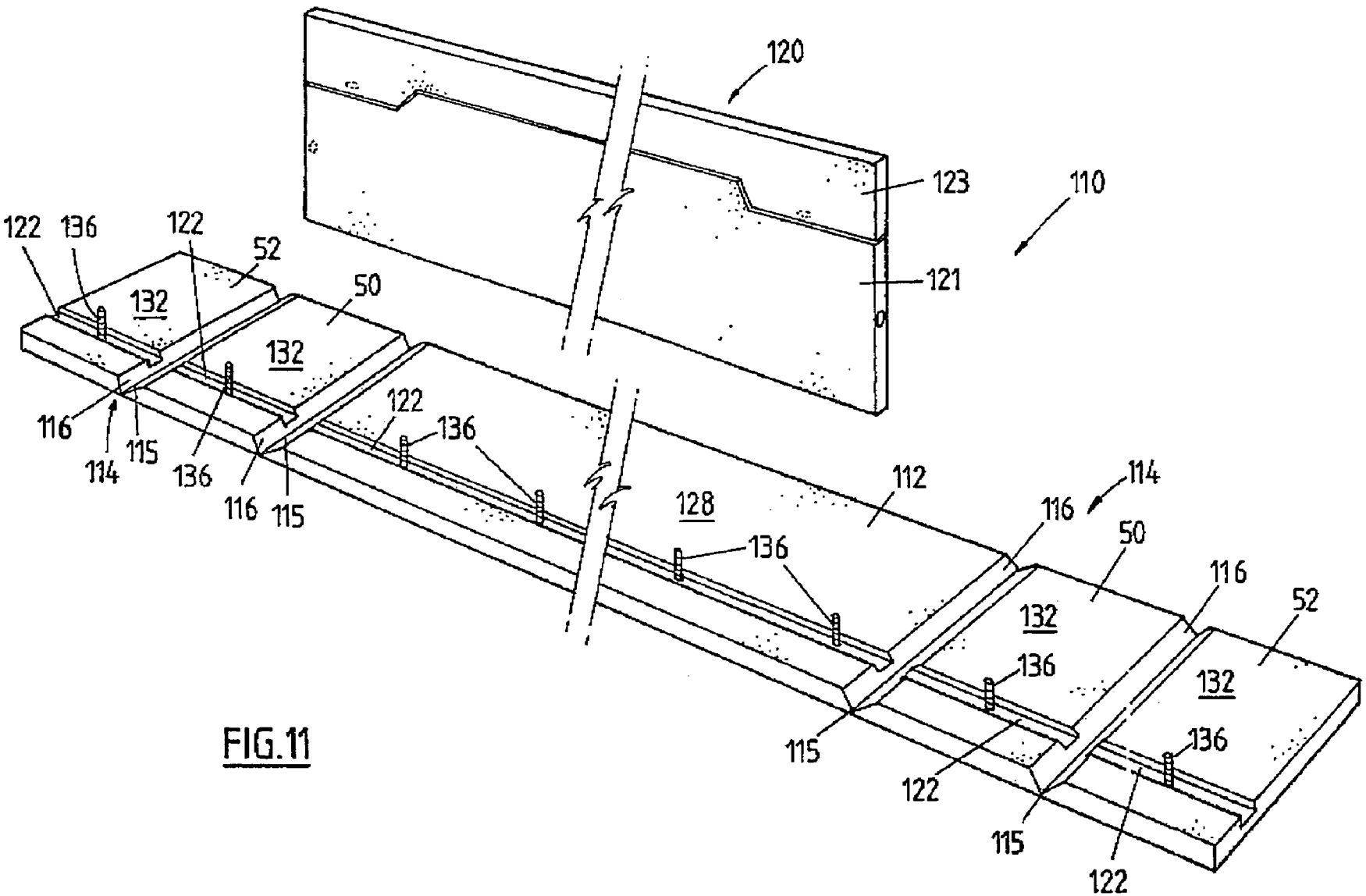
FIG. 11 is a perspective view of the soft furnishing assembly of FIGS. 9 and 10, showing the soft furnishing assembly in a first position prior to construction.
Figure 12:
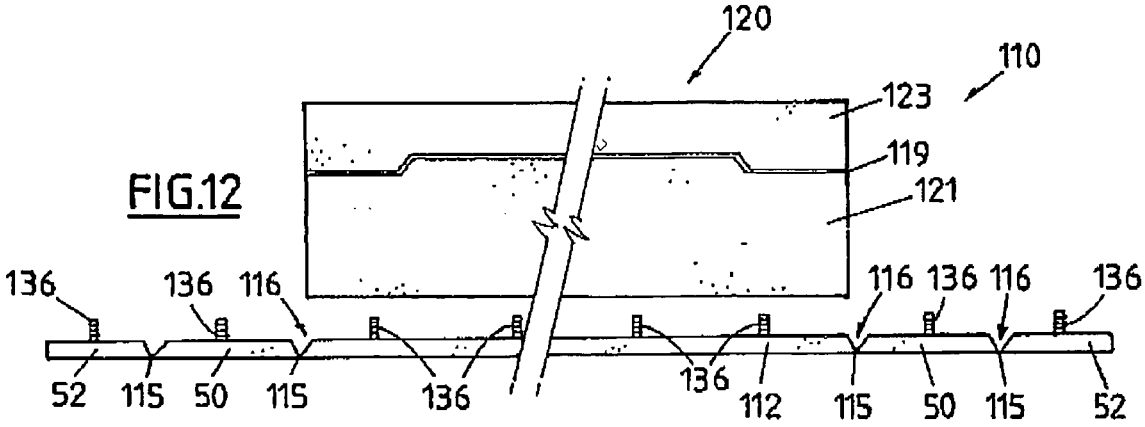
FIGS. 12 to 14 are each an upper perspective view of the soft furnishing assembly of FIGS. 9 and 10, showing the stages of construction of the soft furnishing assembly.

The intermediate portion 112 and end portions 114 are provided with a channel 122, disposed linearly substantially along the length of a rear surface 128 of the intermediate portion 112 and of a rear surface 132 of each of the end portions 114, as shown in FIG. 11. The channel 122 is substantially as hereinbefore described with respect to the previous embodiment.

The channel 122 is arranged to receive a support member 120. The support member 120 is comprised of a first support member portion 121 and a second support member portion 123, shown in FIGS. 10 and 11. The first and second support member portions 121, 123 are releasably connected along longitudinal sides 119 thereof by a connecting means. Preferably, the connecting means comprises a plurality of interengageable fasteners 127. The fasteners 127 are arranged to extend outwardly from a side 119 of the first support member portion 121 and be received by corresponding apertures 117 on a side 119 of the second support member portion 123. The end portions 114 and support member 120 are each provided in two portions to enable the soft furnishing assembly 110 to be provided as an assembly having end portions 114 that may be varied in length. The ability to vary the length of the end portions 114 enables the finished soft furnishings assembly 110 to be arranged in a variety of configurations. For example, if it is desired to install the soft furnishing assembly 110 having end portions 114 of a first length, shown in FIG. 9, the support member 120, comprising both first and second support member portions 121, 123 is placed into the channel 122 of the intermediate portion 112. Fastening members 136, substantially as hereinbefore described with respect to the previous embodiment fasten the support member 120 in this position. In this manner, the constructed soft furnishing assembly 110 will be provided with end portions 114 having a length that is the total length of both first and second end portions 50, 52 and the frangible portion 115 between the portions 50 and 52 remains intact.

If it is desired to install the soft furnishing assembly 110 having end portions 114 that are of a length that is smaller relative to the combined length of the first and second end portions 50, 52, the first support member portion 121 only is placed into the channel 122 of the intermediate portion 112. In this manner, the first end portion 50 may be engaged with sides of the first support member portion 121. The second end portion 52 is broken about the frangible portion 115 between the first and second end portions 50, 52. In this manner, the second end portion 52 engages with a side of the first support member 121 opposite that which is received by the channel 122, as shown in FIG. 10.

In use, the support member 120 is received by the channel 122 of the intermediate portion 112 substantially as hereinbefore described with respect to the first embodiment. If it is desired to construct the soft furnishing assembly 110 having end portions 114 that are of a length of the combined first and second end portions 50, 52, the end portion 114 is angled towards the rear surface 128 of the intermediate portion 112. The end portion 114 is angled by breaking the frangible portion 115 between the end 124 of the intermediate portion 112 and the end portion 114 only. The frangible portion 115 between the first and second end portions 50, 52 remains unbroken.

This step is then repeated with the opposing end portion 114 to achieve the assembled soft furnishing 110 as shown in FIG. 9.

Figure 13:
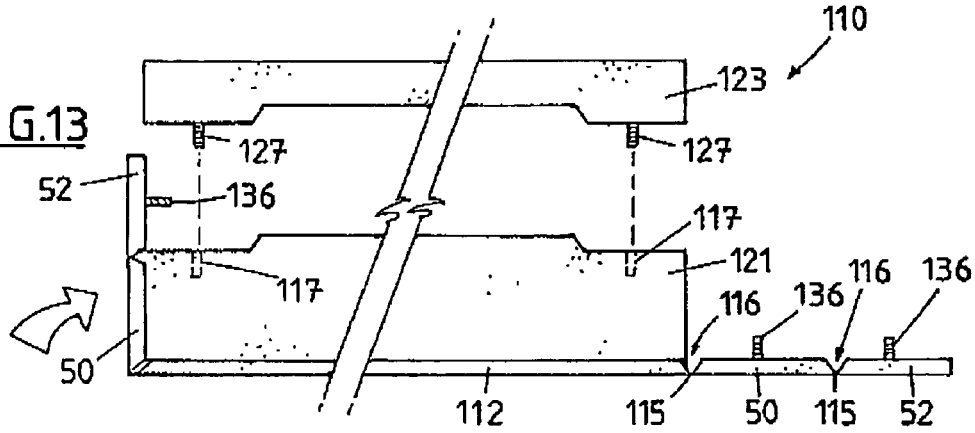

If it is desired to construct the soft furnishing assembly 110 having end portions 114 that are of a length that is smaller to the combined length of the first and second end portions 50, 52, the second support member portion 123 is disengaged from the first support member portion 121, as shown in FIGS. 10 and 13. The first end portion 50 is then angled towards the rear surface 128 of the intermediate portion 112, breaking the frangible portion 115 between the end 124 of the intermediate portion 112 and first end portion 50. The channel 122 of the first end portion 50 may then be engaged with the corresponding side of the first support member portion 121.

The second end portion 52 is then angled towards the rear surface 128 of the intermediate portion 112, breaking the frangible portion 115 between the first and second end portions 50, 52. The channel 122 of the second end portion 50 may then be engaged with the side 119 of the first support member portion 121, opposite the side received by the channel 122 of the intermediate portion 112.

Figure 14:
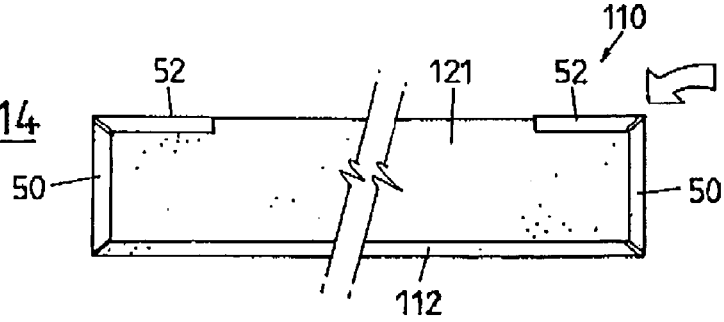

This step is then repeated with the opposing end portion 114 to achieve the assembled soft furnishing 110, ready for installation, as shown in FIG. 14.

Figure 15:
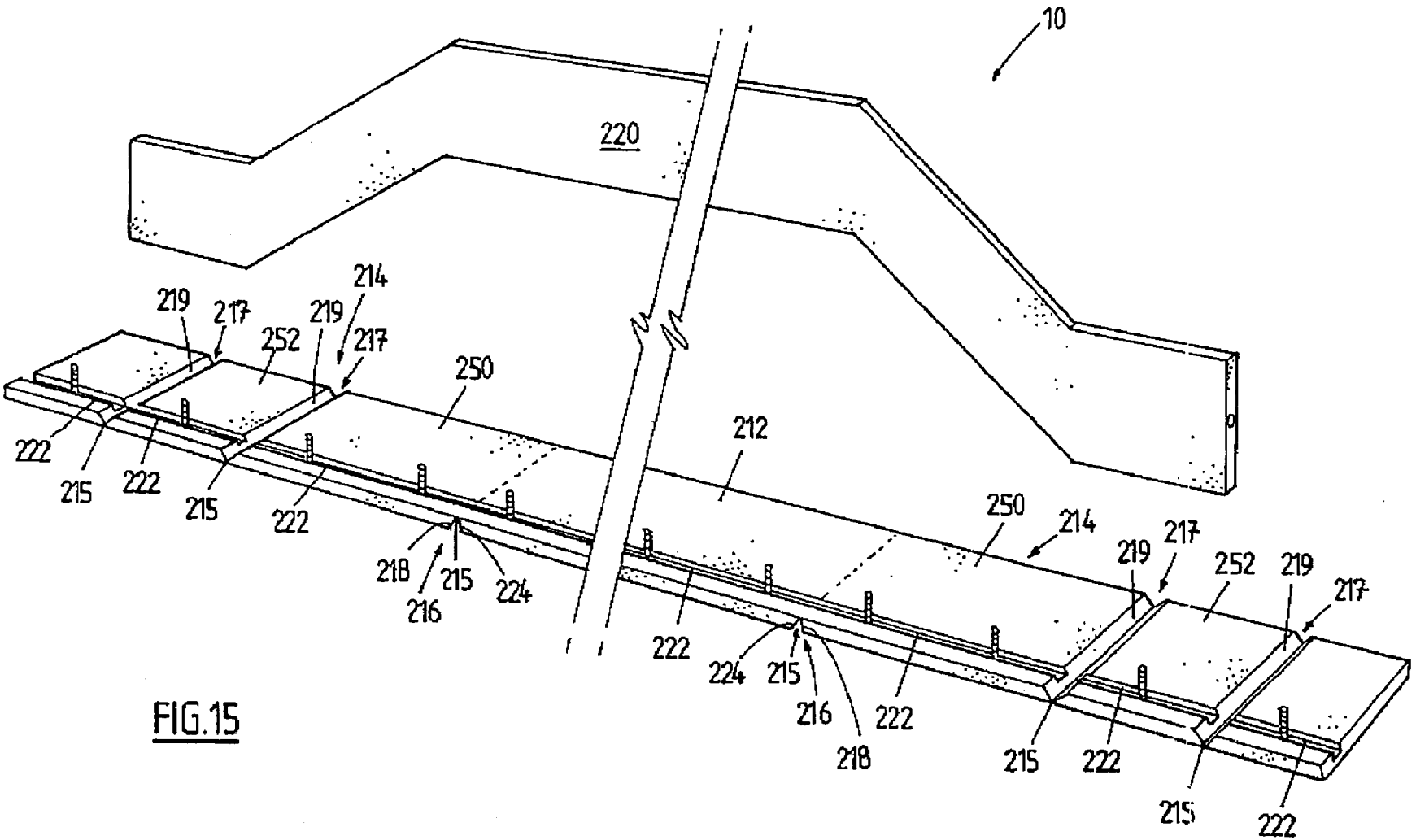
FIG. 15 is a perspective view of a soft furnishing assembly, in particular a pelmet assembly, in accordance with a third aspect of the present invention, showing the soft furnishing assembly in a first position prior to construction.

A third embodiment of the present invention, shown in FIG. 15 is also provided. In this embodiment, there is shown a soft finishing assembly 2210, comprising an intermediate portion 212 and at least one end portion 214 substantially as hereinbefore-described with respect to the second embodiment.

Each end portion 214 may be comprised of a plurality of end portions. Preferably, each end portion 214 comprises at least a first end portion 250 and a second end portion 252. A frangible portion 215 interconnects the first and second end portions 250, 252. Similarly, a frangible portion 215 interconnects the first end portion 250 to an end 224 of the intermediate portion 212.

The first end portion 250 is provided with an inclined surface 218 at an end thereof that is proximal to a respective end surface 224 of the intermediate portion 212. The inclined surface 218 is disposed at an angle which is substantially complementary with the angle of the adjacent end 224 of the intermediate portion 212.

The inclined surface 218 of the end surface 224 of the intermediate portion 212 define a substantially V-shaped groove 216. A frangible portion 215 is disposed at a trough of the V-shaped groove 216. A similar V-shaped groove 217 having a second frangible portion 215 at a trough thereof is defined by inclined surfaces 219 of the first and second end portions 250, 252.

In this embodiment, the respective angles of the inclined surfaces 218 and 219 may be varied in manufacture so as to accommodate the construction of a soft furnishing assembly 210, that is adapted to dress windows or window arrangements that are not linear, such as bay-front windows. For example, it is envisaged that the angle of the inclined surface 218 would be more than 45° such that the first end portion 250 is disposed at an obtuse angle to the adjacent end 224 of the intermediate portion 212. The angle of the inclined surfaces 219 are similarly disposed at an angle that permits the second end portion 252 to be disposed at an angle which accommodates the configuration of the window that is to be dressed with the soft furnishing assembly 210.

The soft furnishing assembly 210 of this embodiment is further provided with a support member 220. A channel 222 receives the support member 220. The channel 222 is disposed linearly substantially along the length of the intermediate portion 212 and of each of the end portions 250, 252. Sides of the support member 220 that are received by the channel 222 present on each of the end portions 250, 252 are accordingly provided at an angle which is complementary to the angle of each of the end portions 250, 252 when in the assembled configuration.

In use, the support member 220 is received by the channel 222 of the intermediate portion 212 substantially as hereinbefore described with respect to the previous embodiments.

The respective first end portions 250 are then moved towards the support member 220, breaking the frangible portion 215 between the end 224 of the intermediate portion 212 and the first end portion 250. The channel 222 of the first end portions 250 accordingly receives the appropriately angled side of the support member 220.

This step is then repeated with respect to the second end portions 252, to give an assembled soft furnishing 210.

Although the above description refers to the construction of a soft furnishing assembly such as a pelmet assembly, it should be understood that the basic method of construction should not be limited to pelmet assemblies only. It is envisaged that the basic construction method comprising the movement of end portions about ends of an intermediate portion wherein a frangible portion is broken to permit placement of the end portions about the intermediate portion may be applied to other types of furnishings. For example, it would be possible to construct soft furnishing items such as a bedside table or stand using the same basic construction method as described above.

Figure 16:
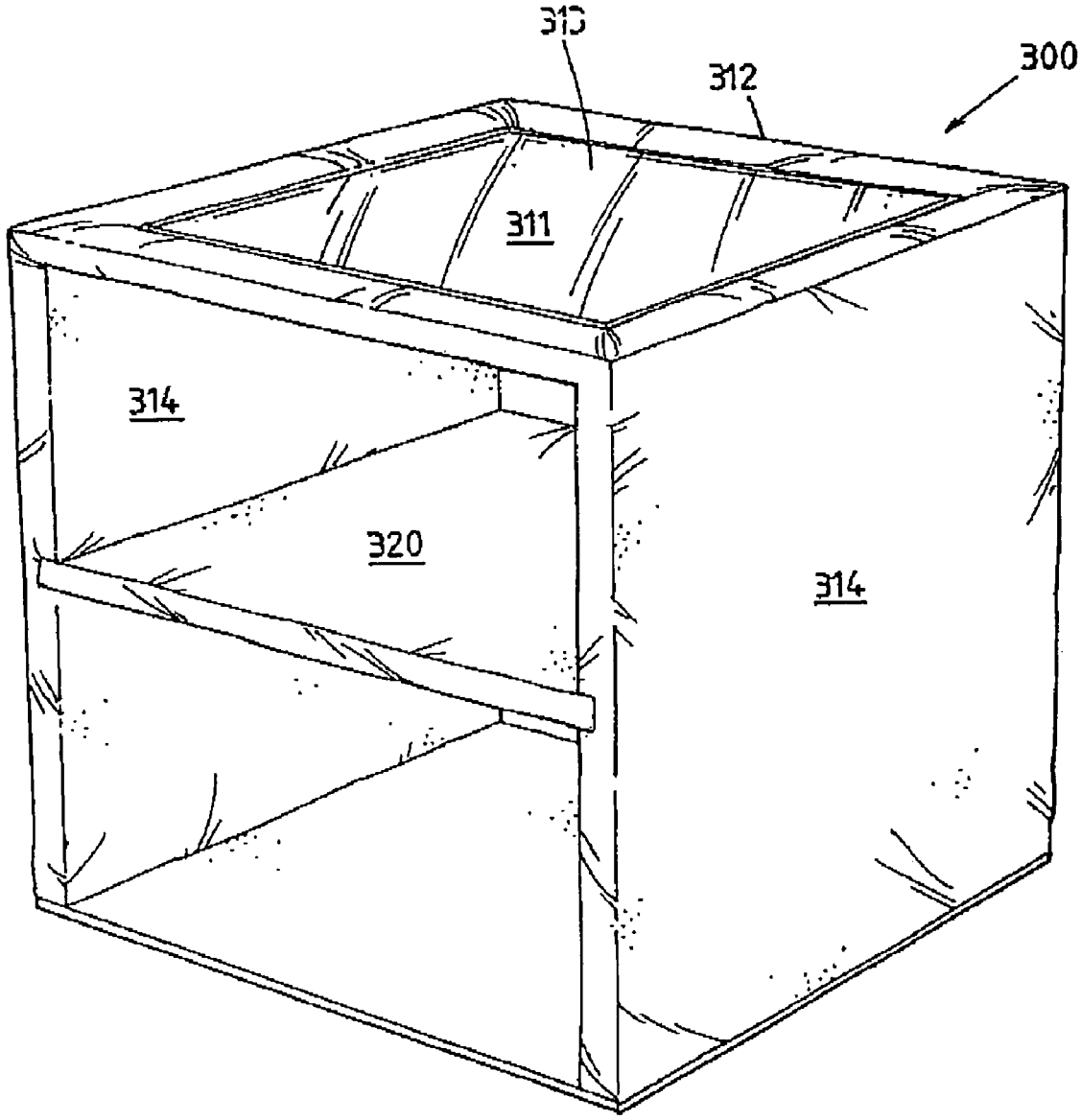
FIG. 16 is an upper perspective view of a table made in accordance with the method of the present invention.
Figure 17:
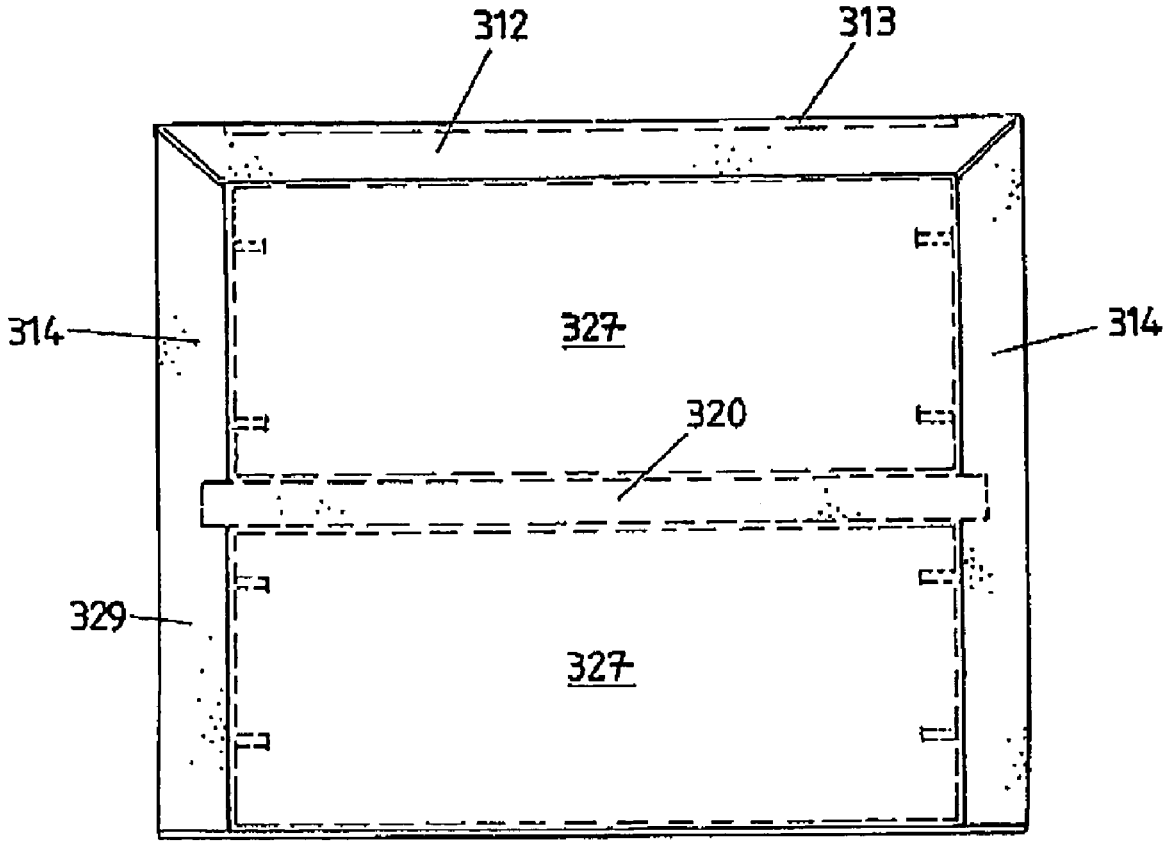
FIG. 17 is a rear perspective view of the table of FIG. 16.

An embodiment of a table 300, such as a bedside table, will now be described, wherein like parts are denoted by like numerals with respect to the previous descriptions of embodiments of soft furnishing assemblies. Referring to FIGS. 16 to 17, there is shown a table 300 comprising an intermediate portion 312 and a pair of opposing end portions 314.

The intermediate portion 312 has an upper surface 326 and a lower surface 328. The upper surface 326 serves as a face onto which decorative material, such as fabric may be applied. The upper surface 326 is provided with a recess 313. The recess 313 is disposed centrally upon the upper surface 326. The recess 313 is adapted to receive a panel member 311. Preferably, the panel member 311 is a glass or translucent plastics material panel. The panel 311 is in use, fitted over any material or upholstering applied to the upper surface 326 of the intermediate portion 312.

An inclined surface 318 of the end portion 314 and an end surface 324 of the intermediate portion 312 define a substantially V-shaped groove 316 when the table 310 is in a first, flat position. A frangible portion 315 is disposed at a trough of the V-shaped groove 316.

The frangible portion 315 is substantially as hereinbefore described with respect to the previous soft furnishing embodiments. The frangible portions 315 are adapted to be broken when the end portions 314 are moved from the first position in which the table assembly 310 is substantially flat, to a second position in which the end portions 14 angularly and downwardly abut adjacent ends 324 of the intermediate portion 312, as shown in FIG. 16.

Each end portion 314 is provided with a channel 322. Each channel 322 is disposed substantially parallel to the V-shaped groove 316. The channels 322 present on each end portion 314 are disposed opposite to each other, such that they are disposed within the same horizontal plane.

The channels 322 are arranged to receive a support member 320. The support member 320 is a substantially flat panel and acts as a shelf in the finished table assembly 310. The support member 320 is secured within the channels 322 by a plurality of fastening members 336. The fastening members 336 protrude outwardly and are arranged at intervals along each channel 322. The support member 320 is accordingly provided with apertures 340 on sides received by the channels 322, corresponding to the placement of the fastening members 336.

The table 310 is further provided with a rear panel 323. The rear panel 323 is comprised of a pair of segments 327. Each segment 327 spans from a rear vertical edge of one end portion 314 to a vertical edge of the opposing end portion 314, as shown in FIG. 17. The segments 327 are disposed such that they are each within the same vertical plane. Each of the segments 327 are held in position by fastening members 336, received in corresponding apertures 340 in sides of the segments 327. The arrangement of each of the segments 327 is such that a space 329 is formed therebetween. The space 329 spans substantially horizontally from one end portion 314 to the opposing end portion 314 when the table 310 is arranged in the second position, shown in FIG. 16. The space 329 is provided to permit a rear edge of the support member 320 to be received therein.

In use, the panel member 311 is first removed from the recess 313. The intermediate portion 312 with end portions 314 attached at ends 324 thereof by the frangible portions 315 is placed so that the V-shaped grooves 316 face upwardly, as shown in FIG. 17. The support member 320 is placed within the channel 322 of one of the end portions 314 and attached therein by engagement of the fastening members 336 with the corresponding apertures 340.

Similarly, an edge of each segment 327 of the rear panel 323 is fastened to the end portion 314 by interengagement of the fastening members 336 with the corresponding apertures 340.

The panel 311 may then be placed back into the recess 311 to achieve the assembled table 310 as shown in FIG. 16.

Modifications and variations as would be apparent to a skilled addressee are deemed to be within the scope of the present invention. For example, it is envisaged that the present invention could be applied in the manufacture of other soft furnishing items, such as stools, foot stools and chairs.

The invention claimed is:

1. A soft furnishing assembly comprising an intermediate portion having opposed ends, and at least one end portion connected to an end of the intermediate portion, the or each end portion being connected to the intermediate portion by a frangible portion, wherein the or each end portion is moveable between a first position in which the soft furnishing assembly is substantially flat and a second position in which the or each end portion angularly abuts an adjacent end of the intermediate portion and the frangible portion is broken; the intermediate portion and the or each end portion being provided with a channel, the channel being disposed substantially along the length of a rear surface of the intermediate portion and of a rear surface of the or each end portion, a support member, the channel being arranged to receive said support member and whereby a plurality of fastening members extend outwardly from the channel, the fastening members being arranged to engage with apertures provided on sides of the support member when the support member is received by the channel.

2. A soft furnishing assembly in accordance with claim 1, wherein the or each end portion has an inclined surface, proximal to a respective end surface of the intermediate portion, the inclined surface of each end portion being the same length as the adjacent end surface, the inclined surface and end surface defining a substantially V-shaped groove, whereby the frangible portion is disposed at a trough of the V-shaped groove when the soft furnishing assembly is in the first position.

3. A soft furnishing assembly in accordance with claim 1, wherein the intermediate portion and the or each end portion is upholstered with a fabric.

4. A soft furnishing assembly in accordance with claim 1, wherein the or each end portion has an inclined surface, proximal to a respective end surface of the intermediate portion, the inclined surface of each end portion being the same length as the adjacent end surface, the inclined surface and end surface defining a substantially V-shaped grove; the intermediate portion and the or each end portion being upholstered with a fabric, and wherein the soft furnishing assembly is provided with a fabric tensioning means in the form of a flexible cord arranged along the length of the V-shaped groove at the rear of the soft furnishing assembly, the flexible cord being attached at a first end to a portion of fabric that protrudes from the V-shaped groove when the soft furnishing assembly is placed in the second position and attached at an intermediate portion to an opposing portion of fabric protruding from the V-shaped groove, whereby the flexible cord is tensioned before securing a second end of the flexible cord to the rear of the soft furnishing assembly, such that upon the or each end portion being moved into the second position, the fabric tensioning means prevents fabric from protruding from the V-shaped groove when the soft furnishing assembly is in the second position.

5. A soft furnishing assembly in accordance with claim 4, wherein the flexible cord is attached at respective ends to a pair of opposing hook members, the hook members being arranged to project from opposing portions of fabric protruding front the V-shaped groove.

6. A soft furnishing assembly in accordance with claim 1, wherein each end portion comprises a first portion and a second portion, the first and second portions being connected by a second frangible portion, wherein the first and the second portions are moveable between a first position in which the soft furnishing assembly is substantially flat and a second position in which the or each second frangible portion is broken and the support member is received by the channel on each of the first and second portions.

7. A soft furnishing assembly in accordance with claim 6, wherein the support member comprises a first support member portion and a second support member portion, the first and second support member portions being releasably connected to one another.

8. A soft furnishing assembly in accordance with claim 7, wherein the second support member portion is arranged to be removed and the or each end portion is arranged to be disposed about the first support member portion such that the second portion is substantially parallel with the intermediate portion.

9. A soft furnishing assembly according to claim 1, wherein the assembly is a pelmet assembly.

10. A method of construction of a soft furnishing assembly, comprising an intermediate portion having opposed ends, and at least one end portion connected to an end of the intermediate portion, the or each end portion being connected to the intermediate portion by a frangible portion, the method comprising the steps of:

engageably arranging a support member upon a rear surface of the intermediate portion;

moving the or each end portion about an end of the intermediate portion such that the or each end portion moves from a first position in which the soft furnishing assembly is substantially flat to a second position in which the or each end portion angularly abuts the adjacent end of the intermediate portion which causes the or each frangible portion to break; and fastening the or each end portion to a side of the support member.

11. A method according to claim 10, wherein the soft furnishing assembly is a pelmet assembly.

12. A soft furnishing assembly comprising an intermediate portion having opposed ends, and at least one end portion connected to an end of the intermediate portion, the intermediate portion and the or each end portion each having rear surfaces and being arranged to form an assembled soft furnishing, wherein the intermediate portion forms a first side of the assembled soft furnishing and the or each end portion forms a respective further side of the assembled soft furnishing, the or each further side being angled to the first side when assembled, the or each end portion being connected to the intermediate portion by a respective frangible portion, said frangible portion being located at a groove between the intermediate portion and the respective end positions on the rear surfaces thereof, whereby the or each end portion is pivotable toward the rear surface of the intermediate portion between a first position in which the sort furnishing assembly is substantially flat and a second position in which the or each end portion angularly abuts an adjacent end of the intermediate portion, and the movement from the first position towards the second causes breaking of the or each frangible portion to enable the or each end portion to be moved to the second position thereof, and means for maintaining the intermediate portion and the or each frangible portion in the second position.

13. A soft furnishing assembly in accordance with claim 12, wherein the intermediate portion and the or each end portion are provided with a channel, the channel being disposed substantially along the length of the rear surface of the intermediate portion and of the rear surface of the or each end portion, the channel being arranged to receive a support member.

14. A soft furnishing assembly in accordance with claim 13, wherein a plurality or fastening members extend outwardly from the channel, the fastening members being arranged to engage with apertures provided on sides of the support member when received by the channel.

15. A soft furnishing assembly in accordance with claim 12, wherein or each end portion has an inclined surface, proximal to a respective end surface of the intermediate portion, the inclined surface of each end portion being the same length as the adjacent end surface, the inclined surface and end surface defining the groove, whereby the frangible portion is disposed at a trough of the the groove when the soft furnishing assembly is in the first position.

16. A soft furnishing assembly in accordance with claim 12, wherein the intermediate portion and the or each end portion is upholstered with fabric.

17. A soft furnishing assembly in accordance with claim 16, wherein the soft furnishing assembly is provided with a fabric tensioning means in the form of a flexible cord arranged along the length of the groove at the rear of the soft furnishing assembly, the flexible cord being attached at a first end to a portion of fabric adjacent a first end of the groove and attached at an intermediate portion to a portion of fabric adjacent an opposing end of the groove, whereby the flexible cord is tensioned and a second end of the flexible cord is secured to the rear of the soft furnishing assembly, such that; the fabric tensioning means prevents fabric from protruding outwardly from adjacent the groove when the soft finishing assembly is in the second position.

18. A soft furnishing assembly in accordance with claim 17, wherein the flexible cord is attached at respective ends to a pair of opposing hook members, the hook members being arranged to project from opposing portions of fabric protruding adjacent the groove at the rear of the soft furnishing assembly.

19. A soft furnishing assembly in accordance with claim 13, wherein each end portion comprises a first portion and a second portion, the first and second end portions being connected by a second frangible portion, wherein the first and the second portions are moveable between a first position in which the soft furnishing assembly is substantially flat and a second position in which the or each second frangible portion is broken and the support member is received by the channel on each of the first and second portion.

20. A soft furnishing assembly in accordance with claim 19, wherein the support member comprises a first support member portion and a second support member portion, the first and second support member portions being releasably connected to one another.

21. A soft furnishing assembly in accordance with claim 20, wherein the second support member portion is arranged to be removed and the or each second portion is arranged to be disposed about the first support member portion such that the second portion is substantially parallel with the intermediate portion.

22. A soft furnishing assembly in accordance with claim 12, wherein the assembly is a pelmet assembly.

* * * * *